United States Patent [19]

Fabbrie

[11] 4,146,979

[45] Apr. 3, 1979

[54] SELF-CLEANING GOLF-SHOE CLEAT

[76] Inventor: Gilbert R. Fabbrie, 6401 Warner, No. 504, Huntington Beach, Calif. 92647

[21] Appl. No.: 844,894

[22] Filed: Oct. 25, 1977

[51] Int. Cl.[2] ..... A43C 15/00; A43B 5/00

[52] U.S. Cl. ..... 36/67 D; 36/59 R; 36/127

[58] Field of Search ..... 36/67 R, 67 A, 67 B, 36/67 C, 67 D, 59 R, 59 A, 127, 134; D2/311, 317

[56] References Cited

U.S. PATENT DOCUMENTS

| | | | |
|---|---|---|---|
| 1,072,794 | 9/1913 | Tradesco | 36/134 X |
| 3,043,026 | 7/1962 | Semon | 36/134 X |
| 3,324,578 | 6/1967 | Brutting | 36/134 X |
| 3,496,656 | 2/1970 | Caine | 36/67 A |
| 4,063,372 | 12/1977 | MacNeill | 36/67 D |

*Primary Examiner*—James Kee Chi

*Attorney, Agent, or Firm*—William C. Babcock

[57] ABSTRACT

The present invention provides a self-cleaning golf-shoe cleat that is threadably secured to a conventional golf shoe, wherein the sole of the shoe includes typical threaded plugs. The self-cleaning golf-shoe cleat comprises a cleat having a main circular body member formed as a shallow, truncated cone with a spike member extending outwardly from the central plane thereof in the well-known cleat arrangement, and with a rearward extending threaded boss adapted to be received in the threaded plug of the shoe, the circular body and the spike being encapsulated within a resilient rubber-like material wherein the resilient material is formed having at least one hollow cavity, so as to collapse about the spike under the weight of the wearer, and being movable generally axially of the spike during recovery from the collapsed position, whereby foreign material adhered to the spike is removed therefrom.

4 Claims, 6 Drawing Figures

SELF-CLEANING GOLF-SHOE CLEAT

BACKGROUND OF THE INVENTION

1. Field of the Invention

This invention relates generally to cleats for use with sport shoes and, more particularly, to a self-cleaning golf-shoe cleat.

2. Description of the Prior Art

As is well known in the art, various problems and difficulties are encountered in providing suitable means for cleaning foreign material, such as grass cuttings, mud, etc., from the soles and cleats of golf shoes.

Many devices have been designed that are separate tools used to either pick the mud or other foreign material from the soles and cleats, or are some sort of brush means.

However, to the applicant's knowledge, there has not been a substantial advancement in the golf-shoe cleats themselves. That is, for years the cleats for these shoes have remained basically the same—these being protruding spikes integrally formed with an annular flange body to engage the surface of the sole of the shoe and with a threaded boss to be screwed into the sole thereof. Thus, these shoe cleats require separate cleaning devices as mentioned.

Accordingly, the following described invention will disclose a new and unique concept that will no longer require the wearer to have additional and separate cleaning means for his shoes, since the present invention will not permit foreign matter to accumulate thereon.

SUMMARY OF THE INVENTION

The present invention comprises a golf-shoe cleat that includes an elongated spike member having an annular truncated flange member integrally formed therewith. The spike extends outwardly or downwardly from the sole of the shoe when standing weight is applied thereto so as to be received in the ground or turf of the playing area. Extending outwardly from the annular flange and opposite from the spike member is an aligned threaded boss member adapted to be received and secured in the sole of the shoe.

However, this cleat is encapsulated within a resilient body member having a dome-like configuration surrounding the spike member, with the small tip end thereof protruding from the central portion of the resilient body, wherein an annular lip is formed to movably engage and wipe the surface of the spike as it is collapsed under the weight applied by the wearer. Thus, as the wearer lifts his foot, the resilient body expands axially about the spike and wipes or forces the foreign material or debris from the shoe and spike member as it returns to its original dome-like configuration. The resilient body includes at least one enlarged cavity which permits the body to fully collapse about the spike member, and yet allow the annular lip to engage the spike in a longitudinal movement thereon.

The annular flange member is disposed within the rear flat-wall portion of the resilient body, thus preventing separtion between the cleat and the resilient body, the wall portion being secured against the sole of the shoe.

OBJECTS AND ADVANTAGES OF THE INVENTION

The present invention has for an important object a provision wherein cleats employed for use with various sport-type shoes, particularly golf shoes, can be provided with a means whereby the cleats will be self cleaned during actual use by the wearer, wherein separate cleaning devices and utensils will no longer be needed.

It is another object of the invention to provide a self-cleaning golf-shoe cleat that includes a resilient means secured to or integrally formed with the cleat to automatically wipe clean, not only the spike member of the cleat, but prevent accumulation of foreign debris on the exposed areas of the sole of the shoe.

It is still another object of the invention to provide one or more cavities in the resilient body in order to allow the resilient material to be displaced when the weight of the wearer is applied, wherein the annular lip member can readily traverse the spike with a wiping engagement.

It is a further object of the invention to provide a device of this character that is capable of being fitted to existing shoes.

It is still a further object of the invention to provide a golf cleat that is self-cleaning, and that includes a biasing means substantially encapsulating the cleat, wherein the body of the biasing means is to be arranged so as not to leave depressions or otherwise damage the green area.

Still another object of the invention is to provide a device of this character that prevents wearing discomfort, and still retains the lightness in the overall weight of the shoe.

It is still a further object of the invention to provide a self-cleaning-cleat device that is relatively inexpensive to manufacture, rugged in construction, and simple in design.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
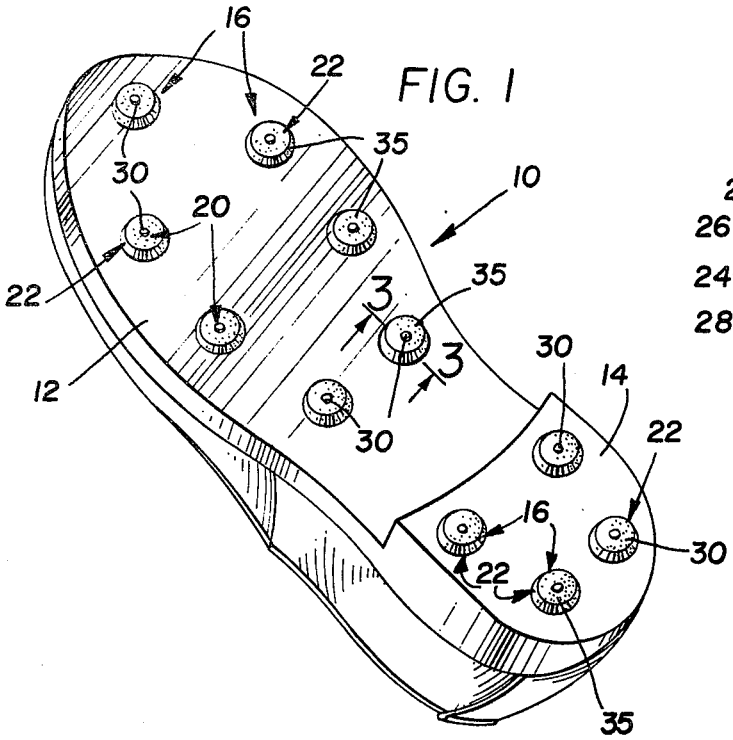
FIG. 1 is a perspective view of a golf shoe showing the present invention mounted thereon.

Referring more particularly to FIG. 1, there is shown a conventional golf shoe, generally indicated at 10, having a typical sole section 12 and a heel member 14.

Mounted and secured to the sole 12 and heel 14 are a plurality of self-cleaning cleat devices, designated by numeral 16.

Figure 3:
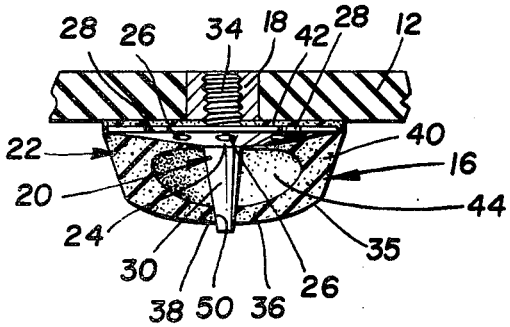
FIG. 3 is an enlarged cross-sectional view taken substantially along line 3—3 of FIG. 1.
Figure 4:
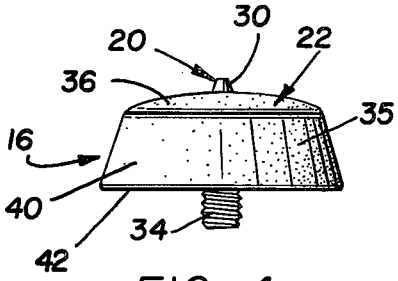
FIG. 4 is a side-elevational view of the cleat having the resilient body-biasing means molded thereto.

Generally, each shoe is provided with a plurality of threaded plugs 18 which are fixedly disposed in sole 12 and heel 14, plug 18 being shown in FIG. 3. In most cases, there are at least eleven plugs spaced about the sole and heel sections in the manner indicated in FIG. 1.

The self-cleaning-cleat device comprises a cleat means, indicated generally at 20, which is similar to that as now used. However, changes have been incorporated therein so as to be compatible with the biasing means, designated at 22, said cleat means 20 being molded within a portion of the biasing means 22.

Accordingly, the cleat means comprises a main circular body member defined by an annular flange member 24, the flange member 24 having a shallow, truncated, cone-shaped configuration. In addition, flange member 24 includes a plurality of holes 26 juxtapositioned about the flange, with notches 28 disposed along the peripheral edge.

Figure 6:
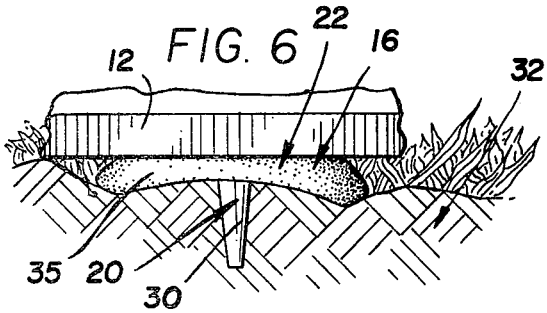
FIG. 6 is an elevational view showing the resilient body in a collapsed configuration and the spike member embedded in the ground surface.
Figure 5:
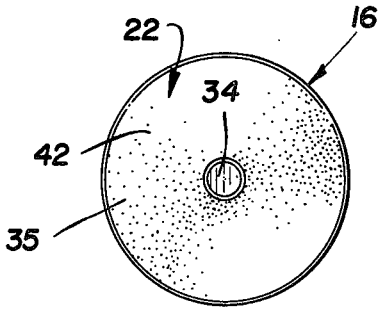
FIG. 5 is a top plan view of the device.

Protruding outwardly in a generally downward direction—that is, downward when applied to the golf shoe in use—is a spike member 30, said spike having a truncated cone shape with a steep cone wall so as to readily penetrate into the ground surface 32, as seen in FIG. 6. Spike member 30 may be formed either as an integral part of flange 24 or arranged to be affixed thereto and centrally located thereon.

Oppositely disposed to spike member 30 and extending upwardly from flange 24 is a threaded boss 34 which is adapted to be threadably received in plug 18, the threaded boss being exposed and clear from the biasing means 22.

Biasing means 22 comprises a resilient enlarged body 35 having a dome-shaped configuration defined by a dome outer surface engaging wall 36 which is provided with an annular, wiping, lip member 38. An inclined, annular, tapered wall 40 is integrally formed to a substantially flat rear wall 42, and the dome wall 36, thus providing a single biasing member formed from a resilient material, such as rubber or a synthetic rubber-like plastic, whereby the dome wall and side walls are allowed to collapse, when pressure in the form of weight by the wearer is provided.

Figure 2:
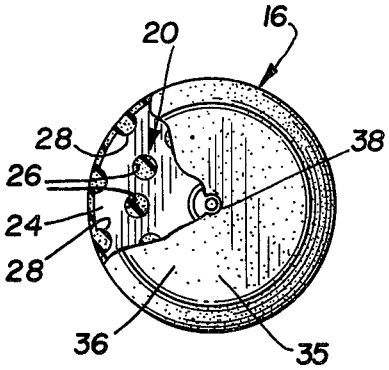
FIG. 2 is an elevational view of the slef-cleaning cleat with a portion thereof broken away for clarity.

Before describing further, it should be noted that cleat means is suitably molded within the biasing member wherein flange member is encapsulated within the rear wall 42, so that a thin layer of resilient material is formed over the rear of the flange and is allowed to be received through holes and notches 26 and 28, respectively, as seen in FIGS. 2 and 3. This arrangement establishes a firm integral connection between the resilient body 35 and the cleat means 20.

Further, there is defined an enlarged cavity 44 in resilient body 35 whereby the cavity provides an area wherein the walls 36 and 40 are permitted to collapse inwardly, as seen in FIG. 6. Thus, as pressure is applied to the resilient body 35, the annular lip member 38 traverses upwardly over spike 30 which has a tapered annular wall, thus causing direct contact with lip 38 as the lip opening 50 is forced to expand. Hence, this will occur each time the wearer places his walking or standing weight thereon; but, as the shoe is lifted during walking, pressure is released on the biasing means and the annular lip member will slidably return axially along the spike during recovery from a collapsed state. As lip member 38 traverses along spike 30, the annular lip opening 50 expands and wipes the foreign material free from spike 30.

It should also be noted that accumulated debris, such as grass cuttings and mud, are also prevented from foring on the open areas of sole 12 and heel 14; since, as the resilient body is flattened outwardly, a greater area of the sole and heel is protected—and, thus, foreign material is not permitted to build up and cover the spikes, as is normally the case will present golf shoes.

It should be further understood that a plurality of small cavities can be formed in the resilient body, whereby the body material is allowed to flow and collapse about the spike member 30.

The invention and its attendant advantages will be understood from the foregoing description, and it will be apparent that various changes may be made in the form, construction and arrangement of the parts of the invention without departing from the spirit and scope thereof or sacrificing its material advantages, the arrangement herein before described being merely by way of example, and I do not wish to be restricted to the specific form shown or uses mentioned, except as defined in the accompanying claims.

I claim:

1. In combination with a golf shoe tht has a sole in which a plurality of spaced plugs are embedded, each of which plugs includes a tapped bore substantially normal to said sole, a plurality of golf cleats that are operatively associated with said plugs, each of said golf cleats including:

a. a rigid flange of substantially greater transverse cross-section than that of said plug;

b. an externally threaded rigid boss tht extends outwardly from said flange and engages said tapped bore;

c. a rigid spike that extends outwardly from said flange and engages said tapped bore;

c. a rigid spike that extends outwardly from said flange in a direction opposite to that of said boss, said spike having a tapered external surface and a free end portion;

d. a molded body of resilient material that includes a first portion in the form of a flat wall in which said flange is embedded and from which said threaded boss projects, and a second wall portion that projects from said first wall portion and cooperates therewith to define a cavity across which said spike extends, and a circular lip opening in said second wall portion that snugly engages said external tapered surface of said spike adjacent said free end thereof when there is no pressure exerted on said resilient body in a direction towards said first wall portion thereof, with said second wall portion deforming towards said first wall portion when subjected to upward pressure as occurs when the user of said golf shoe walks on earth sufficiently soft as to be penetrated by said spike, and said second wall portion when said upward pressure is relieved by said shoe being lifted from the ground returning to its initial configuration and in so doing said lip wiping foreign material from said spike.

2. A golf cleat as defined in claim 1 in which said flange is circular, and said flange having a plurality of spaced openings therein into which said resilient material extends to prevent said flange, threaded boss and spike rotating relative to said molded body.

3. A golf cleat as defined in claim 2 in which said flange is truncated, with said second wall portion being of minimum thickness adjacent said spike, with said lip opening expanding in cross section as said second wall portion deforms towards said first wall, and said lip opening contracting in cross section as said body returns towards its initial configuration.

4. A golf cleat as defined in claim 3 in which said second wall portion is of a dome shaped configuration.

* * * * *